US007877050B2

(12) United States Patent
Montfort et al.

(10) Patent No.: US 7,877,050 B2
(45) Date of Patent: Jan. 25, 2011

(54) REVERSIBLE ECCENTRIC ACTUATOR WIDENS OPTICAL SENSOR SETTING LATITUDE

(75) Inventors: David B Montfort, Webster, NY (US); Donald C Koch, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 331 days.

(21) Appl. No.: 12/193,905

(22) Filed: Aug. 19, 2008

(65) Prior Publication Data

US 2010/0046992 A1 Feb. 25, 2010

(51) Int. Cl.
*G03G 15/14* (2006.01)

(52) U.S. Cl. ..... 399/310

(58) Field of Classification Search ..... 399/297, 399/310, 313, 314, 316, 317
See application file for complete search history.

(56) References Cited

U.S. PATENT DOCUMENTS 4,341,456 A * 7/1982 Iyer et al. ..... 399/297
5,923,921 A * 7/1999 OuYang et al. ..... 399/317
6,078,777 A * 6/2000 Imumi et al. ..... 399/313
6,687,480 B2 * 2/2004 Obrien et al. ..... 399/316
6,766,138 B2 * 7/2004 Obrien et al. ..... 399/316
6,845,224 B1 * 1/2005 Gross et al. ..... 399/316

* cited by examiner

*Primary Examiner*—Susan S Lee
(74) *Attorney, Agent, or Firm*—Ronald E. Prass, Jr.; Prass LLP

(57) ABSTRACT

An improved flag-actuator (actuator) is provided for use in an electrophotographic marking system. This actuator is reversible providing sides 1 and 2, thereby about doubling the useful life of the actuator. Each side 1 and 2 is mounted at different positions on a shaft and permits a much wider range of actuator adjustment than prior art units. Depending upon a tolerance stack-up within the marking system, the user can determine whether to use either side 1 or side 2. The use of this reversible asymmetrical and eccentric actuator allows for the setting of start actuation for nearly double the tolerance stack-up.

14 Claims, 4 Drawing Sheets

REVERSIBLE ECCENTRIC ACTUATOR WIDENS OPTICAL SENSOR SETTING LATITUDE

This invention relates to an electrophotographic marking system and, more specifically, to the transfer station in such a system.

BACKGROUND

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material is made from toner particles adhering triboelectrically to carrier granules. The toner particles are attracted from the carrier granules to the latent image forming a toner powder image on the photoconductive member. The toner powder image is then transferred from the photoconductive member to a copy sheet. Heat is applied to the toner particles to permanently affix the powder image to the copy sheet.

High speed commercial printing machines of the foregoing type handle a wide range of differing weight copy sheets. The beam strength of the copy sheet is a function of the weight of the sheet. Heavier weight copy sheets have greater beam strength than lighter weight copy sheets so additional wear may be put on components in the transfer station. This is called tolerance stack-up. At the transfer station, the copy sheet adheres to the photoconductive member. In the electrostatic transfer of the toner powder image to the copy sheet, it is necessary for the copy sheet to be in uniform, intimate contact with the toner powder image developed on the photoconductive surface. Failure to do so results in variable transfer efficiency and, in the extreme, areas of low or no transfer resulting in image deletions. Clearly, an image deletion is very undesirable in that useful information and indicia are not reproduced on the copy sheet. Various methods have been used to minimize the incidence of image deletions. Hereinbefore, mechanical devices such as rollers have been used to press the copy sheet against the toner powder image on the photoconductive surface.

In another embodiment, a blade is used as a pressing member, adapted to move from a non-operative position spaced from the copy sheet to an operative position contacting the copy sheet and presses the copy sheet into contact with at least the developed image on the photoconductive surface in the transfer station to substantially eliminate any spaces between the copy sheet and the developed image.

The method of transfer includes the steps of establishing, at the transfer station, a transfer field that is effective to attract the developed image from the photoconductive surface to the copy sheet. A blade is moved from a non-operative position, spaced from the copy sheet, to an operative position, contacting the copy sheet, to press the copy sheet into contact with at least the developed image on the photoconductive surface in the transfer station. This substantially eliminates any spaces between the copy sheet and the developed image.

In some prior art systems, the transfer subsystem utilizes a Transfer Assist Blade (TAB) that applies force against the backside of the media that enter the transfer zone. This force is required to hold the paper against the photoreceptor so proper transfer of the image can be achieved to the front side of the media. The TAB has to be able to activate as the media enters the transfer zone and apply force just inside of the lead edge of the media, normally about 3 mm. The TAB will continue to apply force on the media until about 3 mm before reaching the trail edge. The TAB must then deactivate away from the photoreceptor belt in order not to swipe through the toner laden control patches within the interdocument zone. This high-speed activation and deactivation requirement repeats for each subsequent sheet and is timed on the order of milliseconds, otherwise either transfer defects or toner contamination on the backside of the prints result. The drive for this mechanism is generally a stepper motor linked to the TAB assembly. The stepper motor translates between the deactivated position, referred to as the "home" position and the activated position of "home" plus 17 motor steps". The home position is set in manufacturing by pinning the TAB in its home position which is linked to the stepper motor. The stepper motor has an actuator mounted onto its "D" shaft. To set the home position, an adjustable bracket mounting an optical sensor is positioned such that the actuator that is on the stepper motor just trips the optical sensor. However, because of the large tolerance stack-up due to the multitude of parts affecting the linkage, over time the setting of the sensor to the actuator cannot be achieved. This occurs, even though the optical sensor bracket was designed with the maximum allowable adjustment limited by the space constraint within the transfer deck cavity. The inability to adjust the home position has resulted in problems. First, the manufacturing operator may inadvertently improperly set the optical sensor bracket to its limit. In doing so, often the stepper motor over torques when operating at this stressful home position. When the motor over torques, it will skip steps during subsequent operation causing the TAB assembly extrusion to contact the photoreceptor belt and trip a fault. This scenario costs a great deal of money with high spare rates on the transfer deck. Second, when this problem occurs, a rapid re-centered actuator has to be made (rework tool cost) and part shortage to the line. Re-centering the actuator within the sensor position has been shown to be only a short term fix since this had been done before, only to be done again later when the stack-up condition repeats.

SUMMARY

This invention provides a reversible actuator that is physically similar to the existing actuator (and can easily be retrofitted) yet nearly doubles the range of adjustment within the same space constraints by the simple means of reverse mount capability. The actuator is intentionally designed eccentric in terms of the working edges. Depending on the direction of the tolerance stack-up within the system will determine which side of the actuator is used or installed. The use of this reversible eccentric actuator allows for the setting of start actuation for nearly double the tolerance stack-up. By "tolerance stack-up" is meant, wear of the plurality of components in the transfer station caused by extended usage and, or variation in initial manufacture. Once one or more component is worn, the actuator gate must be adjusted to take into consideration this tolerance or wear.

In the prior art, once the home position needed readjustment and could not be adjusted to a useful position, then a complete new transfer station (deck) unit was required. This was very costly and required reinstalling a new unit each time the variation in internal components rendered the sensor bracket inadequate, having gone beyond its useful adjustment limit.

Embodiments of this invention provide an adjustable motor homing system for increased transfer assist blade (TAB) adjustment latitude. The Transfer deck incorporates an adjustable bracket that allows for fine adjustment of the TAB mechanism for optimized transfer. In the prior art, the fine adjustment has limited travel and, due to wear over time, may need to be repeatedly adjusted past its limits for proper operation. The motor drive system that positions the TAB has a homing mechanism incorporating an optical sensor and a flag-actuator. Typically, in the prior art, the flag is symmetrical. This invention provides an asymmetrical flag that can be mounted on the motor shaft with either side of the flag-actuator facing the motor. The combination of the asymmetry and the reversible mounting provides two course adjustment positions for the TAB assembly and can effectively double the adjustment latitude when combined with the fine adjust. The advantages of the present invention are a low cost means of increasing the home position adjustment capability and ease of manufacturing or field repair.

In the present system, it is only required to remove the non-reversible, symmetrical actuator and replace it with a reversible asymmetrical flag-actuator of this invention. The flag-actuator fits over a D-flat on the actuator shaft; in the prior art, the D-flat is perfectly horizontal so that the axis of the flag-actuator is perpendicular to the D-flat. In the present invention, the D-flat is positioned so that the axis of the flag-actuator is not centered or perpendicular to the D-flat but rather is asymmetrical or at an angle not perpendicular to the D-flat. This provides a wider range of adjustment of the flag-actuator and thus therefore the TAB blade. On a top portion of the support for the flag-actuator is an adjustable plate (shown in the drawings as element 5 in FIG. 1) that is loosened by an adjusting nut. This plate having the sensor attached thereto moves in a direction toward and in a direction away from the TAB blade assembly. When the blade assembly requires adjustment, the plate is moved accordingly until the sensors are in operable contact with the flag-actuator. This is shown in the drawings in FIG. 4. Because the flag-actuator is asymmetrical, that is it fits on the D-flat skewed away from a perpendicular position, this enables nearly double the setting capability upon flag-actuator reversal. Therefore, side 1 of the flag-actuator may be, for example, skewed to the right and when the flag-actuator is reversed to side 2, side 2 is skewed to the left. This affords a much longer life for not only the flat-actuator but also for the entire transfer station or unit. This longer life coupled with the wider range of movement for the flag-actuator provides a significant advance in the art.

DETAILED DISCUSSION OF DRAWINGS AND PREFERRED EMBODIMENTS

Figure 1:
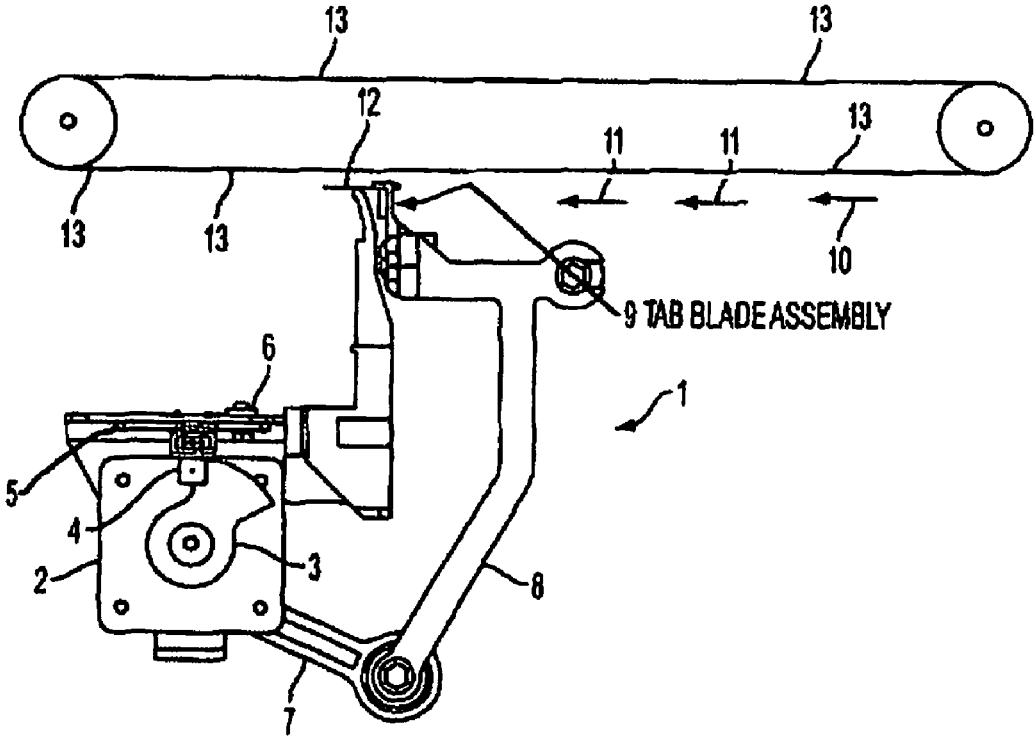
FIG. 1 illustrates the drive mechanism for the transfer assist blade (TAB).

In FIG. 1, a drive mechanism 1 for the transfer assist blade (TAB) is illustrated. A stepper motor 2 provides the power for this drive mechanism 1. Attached to the outer surface of stepper motor 2 is a flag-actuator 3 having initially a side 1 and an inner side 2 that is positioned to be in operative contact with sensor 4. Above sensor 4 and connected thereto is an adjustable plate 5 that is movable horizontally upon loosening nut 6 of adjusting bracket. This moves sensor 4 that is attached to plate 5. Sensor 4, attached to adjustable plate 5, is horizontally adjusted such that the optical sensor just "trips" at a predetermined TAB blade assembly "home" position. The "home" position is established by accurately pinning the TAB blade assembly to the adjacent lifter bar through machined hole/slot features in both parts. Once the adjustment or setting is made to the optical sensor bracket, the software can read the sensor trip signal and thus establish a home position. The software can then tell the stepper motor to rotate a certain number of steps, in either direction, to move arms 7 and 8, which in turn control the up and down movement of blade assembly 9. As paper is fed via path 10 as shown by arrows 11, the paper is pushed by blade 12 into contact with the surface of movable photoconductive belt 13 to enable a toned image on belt 13 to be transferred to the paper being fed between blade 12 and belt 13. Sensor 4 in one embodiment emits a beam that contacts the flag-actuator 3 to operate movement of blade 12. When tolerance stack-up (either wear or manufacturing instability of components) causes the sensor 4 and flag-actuator 3 to be out of adjustment range to establish the "home" position, the asymmetrical flag-actuator 3 of this invention is removed and reversed so that side 2 is now facing outward and provides new adjustment latitude to flag-actuator 3.

Figure 2:
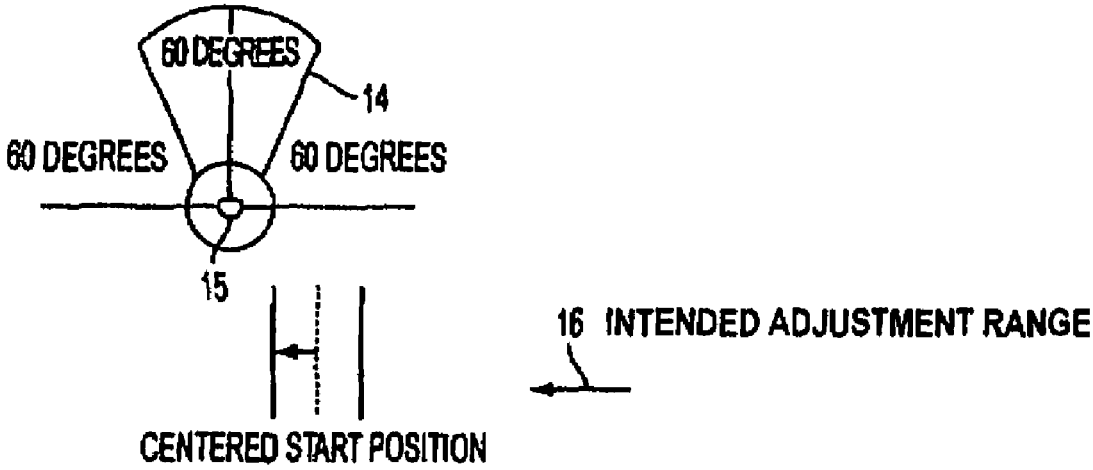
FIG. 2 PRIOR ART
FIG. 2 illustrates the prior art symmetrical flag-actuator.

In FIG. 2, a symmetrical prior art flag-actuator 14 is illustrated. Note that the axis of actuator 14 is perpendicular to D-flat 15 on the end of the actuator shaft. The adjustment range of prior art flag-actuator 14 is limited to approximately 2 mm movement as shown in the adjustment range indication 16. When tolerance stack-up requires adjustment of prior flag-actuator 14 beyond 2 mm, the sensor 4 is no longer able to contact the flag-actuator 14 and the drive mechanism 1 no longer is operable. Reversal of sides of flag-actuator 14 will not be of any assistance since side 1 and side 2 will have the same angular edge movement limitations.

Figure 3A:
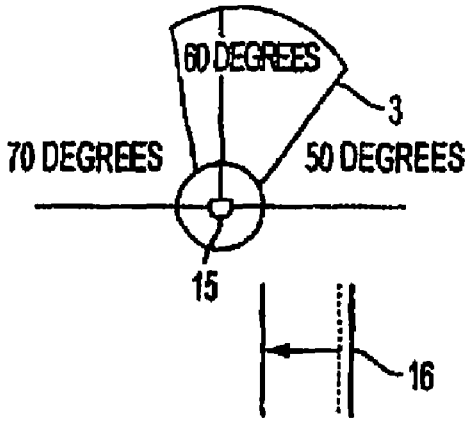
FIGS. 3A and 3B illustrate the reversible asymmetrical flag-actuator configuration of the present invention.
Figure 3B:
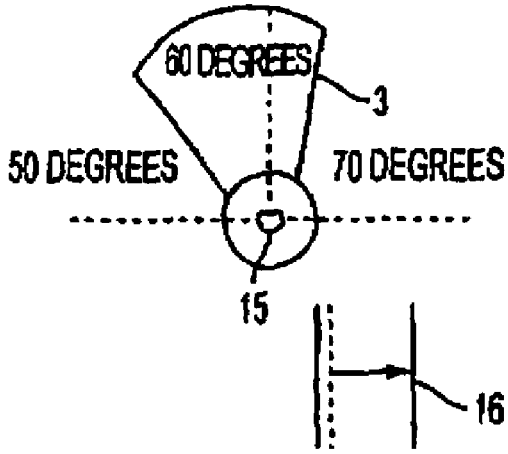

In FIGS. 3A and 3B, embodiments of the flag-actuator 3 of the present invention are illustrated. The skewed start positions of sides 1 and 2 enables nearly double the flag-actuator 3 setting capability upon actuator 3 reversal. In FIGS. 3A and 3B, because of asymmetrical actuator 3, these configurations nearly double the range of adjustment within the same space constraints. Depending on the direction of the tolerance stack-up within the system, it will be determined whether side 1 or side 2 is used or installed. The use of this reversible eccentric actuator 3 allows for the setting of start actuation for nearly double the tolerance stack-up. The present embodiments provide an asymmetrical flag 3 that can be mounted on the D-flat 15 of the motor shaft with either side facing the motor 2. The combination of the asymmetry and the reversible mounting provides two coarse adjustment positions for the TAB assembly 9 and can effectively double the adjustment latitude especially when combined with the fine adjustment. Therefore, the actuator 3 shown with side 1 in FIG. 3A and reversed side 2 in FIG. 3B provides about double the setting capability upon actuator 3 reversal.

Figure 4:
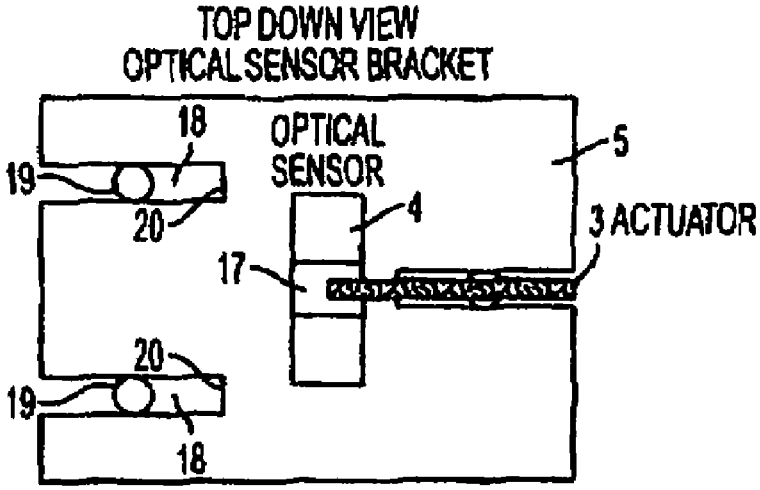
FIG. 4 is a top view of the adjustable plate showing the operative relationship of the actuator to the optical sensor.

In FIG. 4, the adjustable plate 5 is shown as actuator 3 extends into a space 17 within optical sensor 4. As plate 5 with attached sensor 4 is moved, the position of sensor 4 relative to the actuator 3 changes. The slots 18 in plate 5 provide means for the plate to slide in adjusting positions. The slot guides 19 provide supports upon which plate 5 moves along slots 18 in plate 5. When plate 5 is moved so that guides 19 touch slot ends 20, the plate could no longer be adjusted, thus attached sensor 4 will then be out of operable adjustment with flag-actuator 3. If, as in the present invention, flag-actuator 3 is reversed to side 2, guides 19 will have sufficient space in slots 18 for greater adjustment. The use of the reversible asymmetrical flag-actuator 3 of this invention allows for the re-setting of the flag-actuator 3 to nearly double the tolerance stack-up.

Figure 5A:
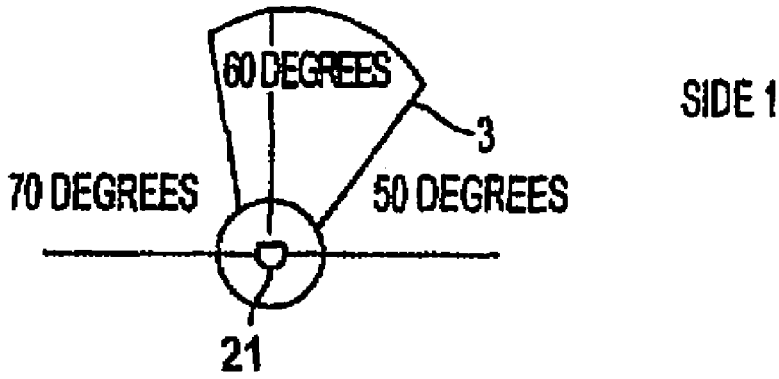
FIG. 5A is a front view of side 1 of an embodiment of the reversible asymmetrical flag-actuator of this invention and FIG. 5B is a front view of side 2 of this same reversible asymmetrical flag-actuator of this invention.
Figure 5B:
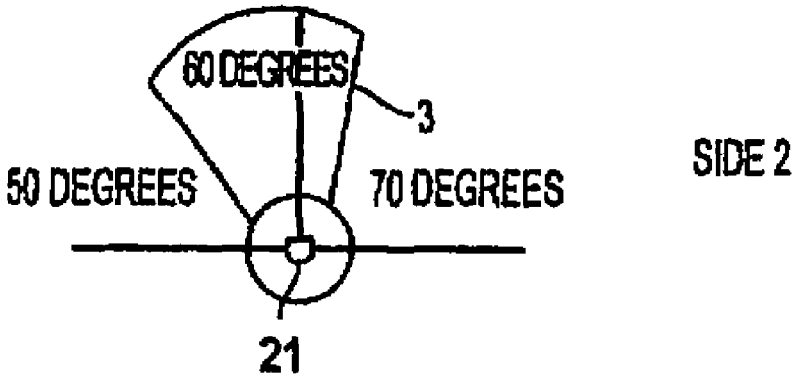

In FIG. 5A, a front view of an embodiment of the flag-actuator 3 of this invention is illustrated. It will be noted that the D-flat opening 21 in this actuator 3, the start position, is rotationally skewed asymmetrically with respect to the flag-actuator edges, as is side 2 as shown in FIG. 5B. These skewed start positions of sides 1 and 2 enable nearly double the flag-actuator 3 setting capability upon reversal from side 1 to side 2. As shown in FIG. 2, the opening in the prior art actuator that fits over the D-flat 15 in a start position is perpendicular to a horizontal axis 22 so that its setting capability is limited to approximately 2 mm whereas in the present invention this setting capability is expanded in one embodiment to approximately 4 mm.

While, for the purpose of clarity, FIGS. 5A and 5B illustrate specific angular skew dimensions, any suitable skew of the mount feature, in this case a D-flat, with respect to the actuator "trip" edge features is within the scope of this invention provided the reversible sides 1 and 2 provide different skewed angles. So, while side 1 may be skewed to the right at an offset angle, when reversed side 2 will be skewed to the left at an offset angle. This will provide expanded adjustment capability.

To summarize, embodiments of the present invention provide a transfer station for an electrophotographic marking system comprising a blade assembly, a motor, a flag-actuator and a sensor. This blade assembly comprises a blade configured to press a copy sheet into contact with a developed image on a photoconductive surface. The blade assembly is adapted to move the blade from an inoperative position where the blade is spaced and out of contact from the copy sheet to an operative position where the blade presses the copy sheet into contact with the toned-developed image on the photoconductive surface. The blade assembly is operatively, movably connected to the flag-actuator and the flag-actuator is configured to be activated by the sensor. The flag-actuator has an asymmetrical and reversible configuration and has a reverse mount capability.

The flag-actuator is reversible and has a side 1 and a side 2, each having a different skewed start position when mounted on a D-flat in the actuator shaft. This reversible, asymmetrical flag-actuator provides a substantially larger range of adjustment within the same space constraints of prior art flag-actuators. The flag-actuator is mounted at an angle on the D-flat other than at a right angle. The side 1 of the reversible flag-actuator is configured to be mounted on the D-flat at a different angle than that on side 2 of the flag-actuator. The flag-actuator of this invention is physically similar to prior art actuators and is adapted to be easily retrofitted into existing transfer stations.

The flag-actuator is in operative electrical contact with the sensor and is configured to be repositioned in contact after prolonged use and is useful for an extended period longer than prior art actuators.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A transfer station for an electrophotographic marking system comprising:

a blade assembly, a motor, a flag-actuator, and a sensor, said blade assembly comprising a blade configured to press a copy sheet into contact with a developed image on a photoconductive surface, said blade assembly that moves said blade from an inoperative position where said blade is spaced from said copy sheet to an operative position where said blade presses said copy sheet into contact with said developed image on said photoconductive surface, said blade assembly operatively connected to said flag-actuator, said flag-actuator configured to be activated by said sensor, said flag-actuator having an asymmetrical configuration and thereby being reversible having a reverse mount capability, said flag-actuator having a mount opening to fit over a D-flat, said mount opening set at an axis not perpendicular to a horizontal axis.

2. The transfer station of claim 1 wherein said flag-actuator is reversible and has a side 1 and a side 2, each having a different skewed start position when mounted in said system.

3. The transfer station of claim 1 wherein said flag-actuator is mounted on a D-flat portion of an actuator shaft, said flag-actuator mounted at an angle on said D-flat other than at a right angle to thereby increase its flag-actuator adjustment capability when reversed to a side 2 from a side 1.

4. The transfer station of claim 1 wherein a side 1 of said flag-actuator is configured to be mounted on said D-flat at a different angle than a side 2 of said flag-actuator.

5. The transfer station of claim 1 wherein said flag-actuator is in operative electrical contact with said sensor.

6. The transfer station of claim 1 wherein said flag-actuator and said sensor while in operable contact are enabled to move said blade assembly and said blade into and out of contact with said copy sheet.

7. A transfer station for an electrophotographic marking system comprising:

a blade assembly, a motor, a flag-actuator, and a sensor, and a flag-actuator adjusting plate said blade assembly comprising a blade configured to press a copy sheet into contact with a developed image on a photoconductive surface, said blade assembly that moves said blade from an inoperative position where said blade is spaced from said copy sheet to an operative position where said blade presses said copy sheet into contact with said developed image on said photoconductive surface, said blade assembly operatively connected to said flag-actuator, said flag-actuator configured to be activated by said sensor, said flag-actuator having an asymmetrical configuration and thereby being reversible having a reverse mount capability, said adjusting plate being movable and configured to adjust said sensor into operative contact with said flag-actuator, said sensor attached to and movable with said adjusting plate, said motor being a stepper motor and enabled to provide operation of components in said transfer station.

8. The transfer station of claim 7 wherein said flag-actuator is reversible and has a side 1 and a side 2, each having a different skewed start position when mounted in said system.

9. The transfer station of claim 7 wherein said flag-actuator is mounted on a D-flat portion of an actuator shaft, said flag-actuator mounted at an angle on said D-flat other than at a right angle.

10. The transfer station of claim 7 wherein a side 1 of said reversible flag-actuator is configured to be mounted on a D-flat at a different angle than a side 2 of said flag-actuator.

11. The transfer station of claim 7 wherein said flag-actuator is in operative electrical contact with said sensor.

12. The transfer station of claim 7 wherein said flag-actuator and said sensor while in operable contact are enabled to move said blade assembly and said blade into and out of contact with said copy sheet.

13. A replacement flag-actuator configured to be easily retrofitted into a transfer station of an electrophotographic marking system, said flag-actuator comprising:

an asymmetrical configuration, a connecting D-flat shaped opening is enabled to mate with a D-flat on an actuator shaft, said opening positioned so that when installed onto said shaft it will have a vertical axis at other than a right angle to a horizontal plane, said flag-actuator being reversible and having a side 1 and a side 2 wherein said vertical axis of these sides will be complimentary to each other to form a 90° angle.

14. The replacement flag-actuator of claim 13 wherein said opening is skewed so that its flat portion is positioned at other than a right angle relative to the vertical axis of said flag-actuator.

* * * * *